US005213525A

United States Patent [19]

Sanford

[11] Patent Number: 5,213,525

[45] Date of Patent: May 25, 1993

[54] JACKETED MARINE PROPELLER

[76] Inventor: Michael P. Sanford, 1150 Shawsheen St., Tewksbury, Mass. 01876

[21] Appl. No.: 710,965

[22] Filed: Jun. 6, 1991

[51] Int. Cl.[5] ..... B63H 1/14

[52] U.S. Cl. ..... 440/49; 440/66

[58] Field of Search ..... 440/48, 49, 67, 66; 416/189

[56] References Cited

U.S. PATENT DOCUMENTS 1,092,960 4/1914 Taylor ..... 416/189 R 2,091,677 8/1937 Fredericks ..... 416/189 R 2,903,076 9/1959 Johannesen ..... 416/189 R

FOREIGN PATENT DOCUMENTS 1325395 8/1973 United Kingdom ..... 416/189 R

*Primary Examiner*—Ed Swinehart

*Attorney, Agent, or Firm*—John P. McGonagle

[57] ABSTRACT

A turbine type, jacketed propeller which has a venturi jacket formed around and with the propeller. The propeller blades are shaped in conjunction with the jacket so as to load the blades with more water and keep the water on the blades to help maintain pressure for propulsion.

10 Claims, 4 Drawing Sheets

JACKETED MARINE PROPELLER

BACKGROUND OF THE INVENTION

This invention relates to water propulsion devices and more particularly to enclosed shield marine propellers of one unit construction for augmenting propeller thrust and/or guarding the propeller against underwater obstruction.

It is the common practice to propel watercraft by means of the reaction obtained by the engagement of propeller blades with water. Conventional propeller blades depend on the angular blade action on the water to propel the watercraft. While forward movement of the watercraft is obtained in this manner, forward force efficiency is low. The radial movement of the blades about the longitudinal shaft causes water to be thrown off centrifugally. The centrifugal effect means that force is being exerted radially, thereby reducing forward, longitudinal force. The force intended for forward propulsion is wasted by the blades radially and tangentially agitating the surrounding water which in turn causes cavitation.

Cavitation is the rapid formation and collapse of vapor pockets in a flowing liquid in regions of very low pressure caused by the axial movement of the blades. Specifically, it is an aeration phenomena which causes the blades to lose their "grip" on the water. Cavitation is a result of the propeller blades spinning so fast that the water pressure against the blades decreases so as to actually make the water boil. As the bubbles of water collapse on the surface of the blades the metal blades can be eaten away, and this is in fact a frequent cause of structural damage to propellers. Forward propulsion is lost because thrust is directly proportional to the blades "gripping" efficiency.

Many serious accidents have occurred to persons water skiing or swimming in the vicinity of the exposed propellers of water craft. Furthermore, the waves created by the exposed propeller's radial water churning, are hazardous to nearby light craft, such as sail boats, canoes, and the like. Exposed propellers are also at risk from rocks and such lying in shallow water, which cause breakage of shear pins or damage to the propeller itself.

Although shrouded propellers have commonly been used for vessels in order to improve thrust, most involve fitting a ring nozzle around a propeller and use bulky bolt-on devices which usually only provide marginal improvements in thrust. The propeller blades of these type devices are not usually connected directly to the shroud. The shroud is commonly bolted to the out drive and is static with respect to propeller movement. The space between the rotating propeller blades outer radial edges and interior of the static shroud prevents good water flow and creates water friction. A common result of this arrangement is "burnt" ends of the propeller blades.

Although basket-like guards have been used for years by boaters in bayous and swamps to keep weeds and grass from fouling props, few is any safety propeller guards are currently being marketed. Those guards which are available, typically plastic cylinders with metal mountings, could reduce boat speeds by as much as twenty-five to thirty percent.

SUMMARY OF THE INVENTION

In view of the foregoing disadvantages inherent in the known types of devices now present in the prior art, the present invention provides an improved jacketed marine propeller. To attain this, the present invention provides a turbine type, jacketed propeller which has a venturi jacket formed around and with the propeller or turbine type blades. The jacket is slightly tapered so as to load the blades with more water and keep the water on the blades to help maintain pressure for propulsion. Unlike conventional propellers that can cause cavitation by throwing water off the side edge of the blades and not grabbing enough water and holding it, the present invention has no side ends for the water to fly off of. The venturi jacket helps eliminate water slippage. The present invention is self-contained. There are no exposed blades that can be damaged by coming in contact with submerged objects. This also helps reduce the possibility of injury to swimmers, divers and water skiers. Integration of the blades with the jacket make the entire propulsion unit three to five times stronger than conventional propellers.

Accordingly, a primary main objective of the present invention is to provide a propeller assembly for water craft which is thrust enhancing.

A further objective of the invention is to provide an assembly in which the propeller may be operated with appreciably higher efficiency and at considerably greater speeds and less cavitation than has heretofore been considered as practical.

Another objective of the present invention is to provide a propeller assembly which effectively prevents accidents to nearby bathers.

A further objective is to provide such a propeller assembly which may be easily attached to the shaft of present-day outboard motors, or to the stern drive of present-day inboard motors.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
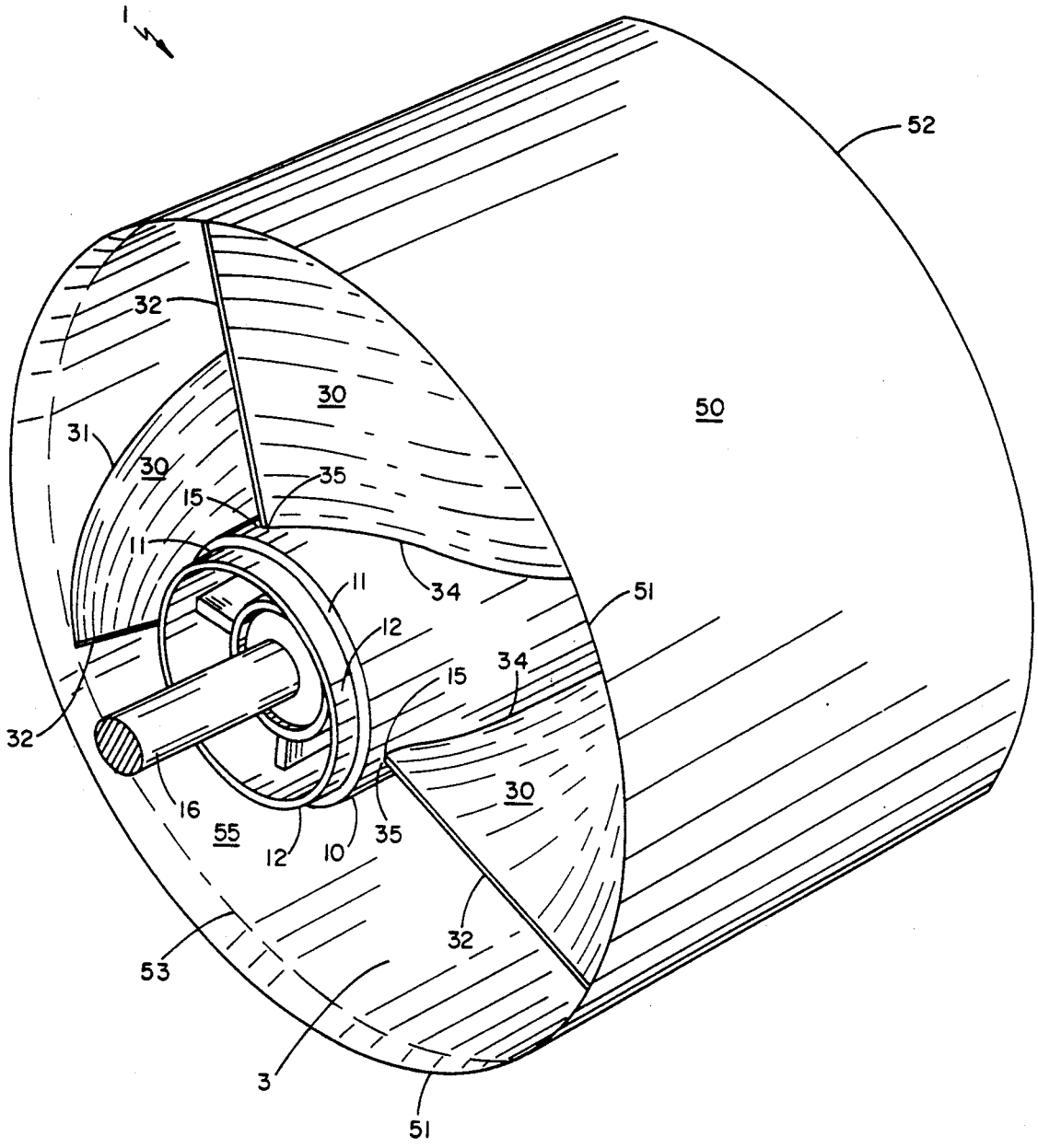
FIG. 1 is a front perspective view of one embodiment of the invention.
Figure 2:
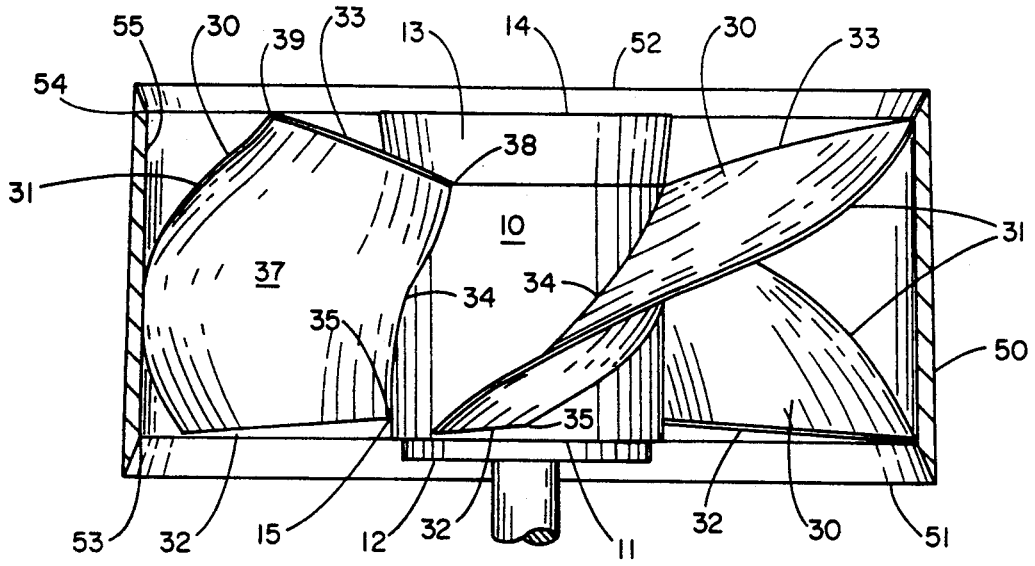
FIG. 2 is a top plan view thereof, partly in section.
Figure 3:
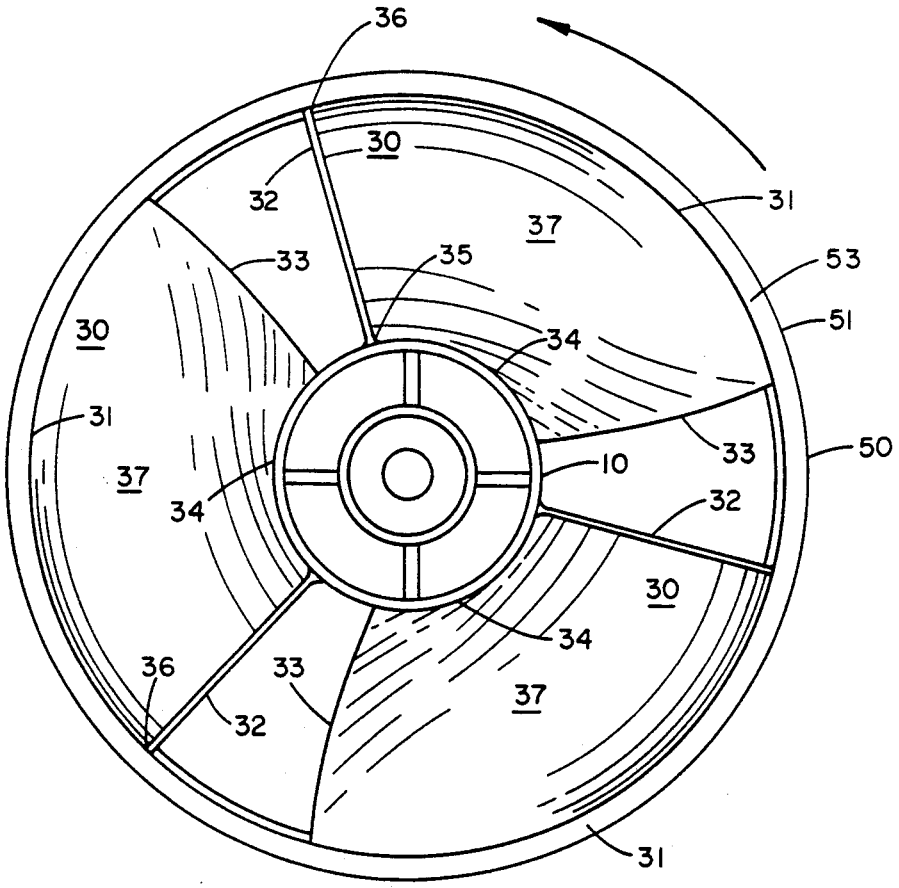
FIG. 3 is a front elevational view thereof.
Figure 5:
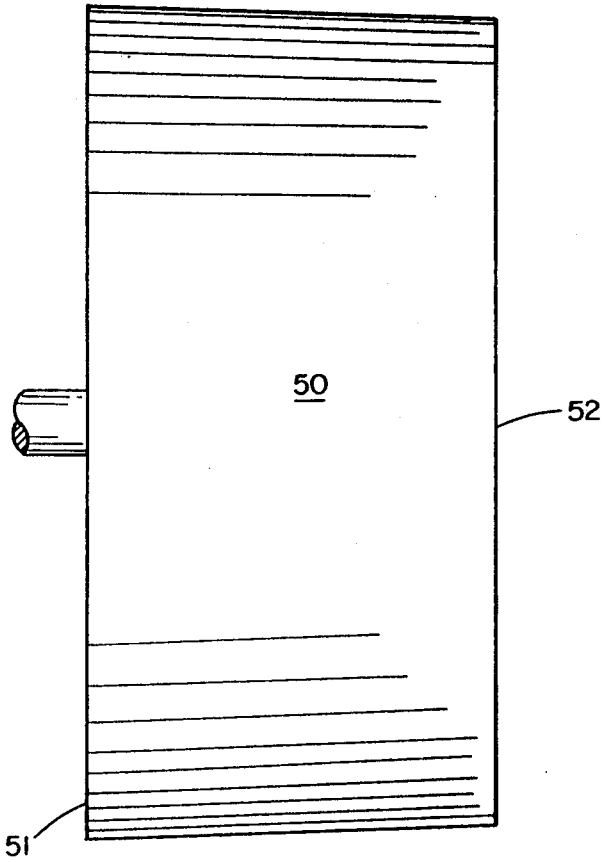
FIG. 5 is a right side elevational view of the embodiment of FIG. 1.
Figure 4:
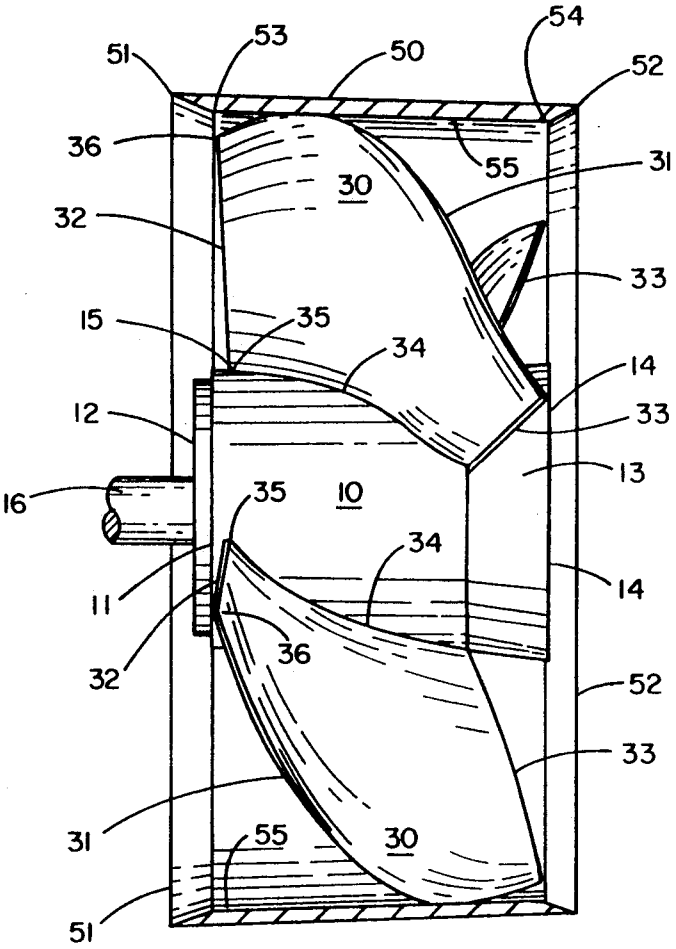
FIG. 4 is a right side elevational view, with a portion of the jacket cut away, thereof.
Figure 7:
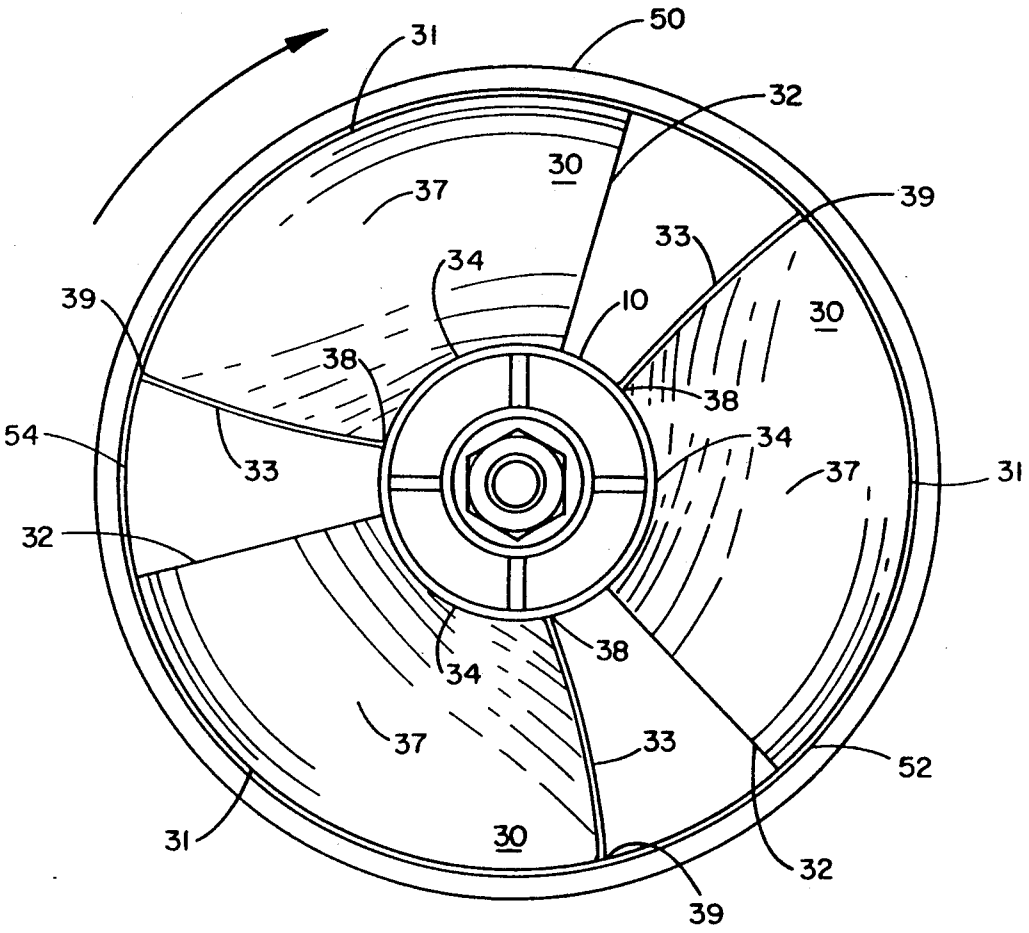
FIG. 7 is a rear elevational view thereof.
Figure 6:
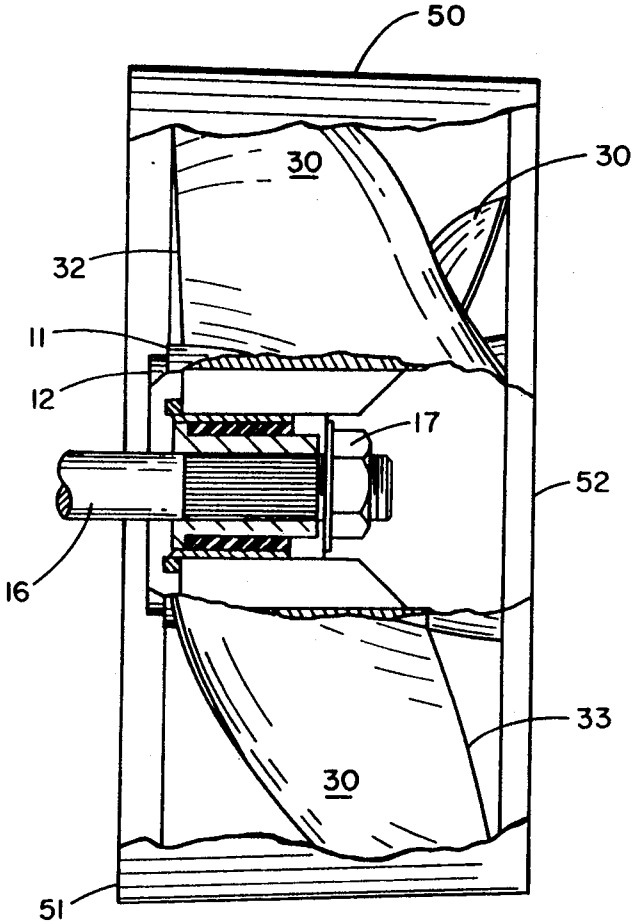
FIG. 6 is a right side elevational view, partly in section, thereof.

Referring to the drawings in detail wherein like elements are indicated by like numerals, there is shown an embodiment of the invention 1 incorporating a jacketed marine propeller. There is shown in FIGS. 1–7 a propeller assembly comprised of a central, elongated hub 10, three helical blades 30 radially attached to said hub 10, and a cylindrical jacket 50 formed about and integrated with the tip edges 31 of said blades 30. Alternate embodiments could have four or more blades. The jacket 50 has an inner surface 55 and an outer surface 56, and lies in a radial plane nearly parallel with the radial plane of said hub 10.

In this embodiment, the jacket 50 has a length of ten inches and tapers from a leading edge 51 diameter of fourteen and one-half inches to a lagging edge 52 diameter of fourteen inches, thereby providing a venturi effect on the water entering and exiting the jacket 50. These dimensions will vary directly with the overall propeller diameter. As the propeller overall diameter increases so will the above dimensions, and vice versa. The leading edge 51, defined as the forward edge, of the jacket shell 50 is very thin and gradually expands moving longitudinally rearward toward the lagging edge 52, i.e., rearward edge, to a thickness of between one-eighth to three-sixteenths inches at a point 53 approximately one inch to the rear of the leading edge 51 and then maintains a constant thickness until reaching a point 54 one-half inch forward of the lagging edge 52 of the jacket shell 50. The jacket shell 50 thickness then decreases over the last half inch to a very thin lagging edge 52. The jacket outer diameter of the leading edge 51 tapers back one inch from a diameter of fourteen and one-half inches to a diameter of fourteen and three-eights inches. The jacket outer diameter then gradually tapers to fourteen inches over the next nine inches of jacket length. The leading edge 32 of each blade 30 joins the inner surface 55 of the jacket 50 at a point 53 one inch back from the jacket leading edge 51.

The hub 10 also has a leading edge 11 and a lagging edge 14. The hub's leading edge 11 has a forward extension 12 to fit inboard/outboard and outboard engines. As may be seen in FIG. 6, the hub 10 is substantially conventional in design using a standard center bore for the shaft 16 and a locknut 17 for attachment to said shaft 16 at the lagging edge 14 of the hub 10. As may be seen in FIG. 4, in this embodiment of the invention 1 the outer diameter of the hub 10 is four and one-half inches increasing to four and three-quarter inches during the last inch section 13 ending at the hub lagging edge 14.

In this embodiment, the propeller assembly 1 has three blades 30. Alternative embodiments could easily have four, five or even six blades. Regardless of the embodiment, each blade 30 is helical with respect to the hub 10 and has a curved, quadrilateral perimeter, with a leading edge 32, lagging edge 33, jacket edge 31, and root edge 34. The root edge 34 is that portion of the blade 30 fixed to the hub 10. The jacket edge 31 is that portion of the blade 30 joined to the inside surface 55 of the jacket 50. The jacket 50 and blade jacket edges 31 are formed as a single unit. Prior art devices have a jacket or shroud bolted onto the blades. The instant invention 1 avoids the bulkiness, fastener drag, and water friction of the prior art devices and is much stronger with each blade reinforcing the other.

The leading edge 32 of each blade 30 is generally straight. The root point 35 of the blade leading edge 32 is fixed to the hub 10 at a point 15 one inch rearward of the jacket point 36 of the blade leading edge 32. The blade 30 itself is not shaped like a conventional blade but has a greater "belly" 37 or trough formed from leading edge 32 to lagging edge 33 thereby increasing the surface area of the blade 30 and enabling the blade 30 to exerting more pressure on the water in the channel 3 formed between the hub 10 and inside surface 55 of the jacket 50. The blade leading edge 32 is beveled from a very thin edge to a normal blade thickness, thereby helping water flow into the channel 3.

The jacket and hub edges, 31 and 34, of the blade 30 curve along the jacket 50 and hub 10 until reaching the lagging edge 33 of the blade 30. The root point 38 of the blade lagging edge 33 is approximately one inch rearward of the jacket point 39 of the blade lagging edge 33. The lagging edge 33 is slightly cupped thereby further reducing cavitation and adding thrust.

The very thin jacket and blade leading edges, 51 and 32 substantially reduce water resistance and water flow into the channel 3 formed between the hub 10 and jacket 50. Water resistance and drag have been traditional problems with shrouded propellers. The venturi shape of the channel 3 and deeper blade troughs 37 enable tremendous pressure to be exerted on the water contained within the channel 3. The formation of jacket 50 and blades 30 into one unit enable the instant invention to withstand the forces involved. The improvements in design of the instant invention thereby overcome various limitations of the prior art and enable the instant invention 1 to increase longitudinal rearward thrust.

In operation, the jacketed propeller assembly 1 is bolted with a locknut 17 onto a marine engine shaft 16. The assembly 1 rotates as an integrated unit in a counter clockwise direction as viewed in FIGS. 1 and 3. The forward venturi shaped jacket section 51–53 increases rearward water pressure before the blades 30 meet the water. The very thin leading edges 51 and 32 of the jacket 50 and blades 30 provide minimum resistance to water as the assembly 1 moves in a forward direction. The blades 30 impart a partially axial, partially radially outward movement to the water entering from the forward jacket section 51–53. The integrated jacket shell 50 converts the radially moving water to axial movement, thereby increasing forward thrust. The deep troughs 37 of the blades 30 provide additional pressure on the water thereby further increasing thrust. The cupped lagging edges 33 of the blades further reduces cavitation.

It is understood that the above-described embodiment is merely illustrative of the application. Other embodiments may be readily devised by those skilled in the art which will embody the principles of the invention and fall within the spirit and scope thereof.

I claim:

1. A self-contained jacketed marine propeller assembly comprising:

a central elongated hub;

a plurality of substantially identical blades each of which is radially attached to and helical with respect to said hub and has a curved perimeter with a leading edge, lagging edge, tip edge, and root edge; and an annular, slightly tapered jacket formed around and integrated with the tip edges of said blades and defining a passageway through which water flows to augment propeller thrust, said jacket having an inner surface, an outer surface, a leading edge, defined as the forward edge, and a lagging edge, defined as the rearward edge, wherein the diameter of the leading edge is greater than the diameter of the lagging edge, and wherein the jacket leading edge is a very thin, gradually expanding longitudinally rearward to a thickness of between one-eighth to three-sixteenths inches at a point approximately one inch rearward of the leading edge wherein a constant thickness is maintained until reaching a point approximately one-half inch forward of the lagging edge wherein the shell thickness decreases rearwardly to a very thin lagging edge.

2. A propeller assembly as recited in claim 1 wherein: the leading edge of each blade joins the inner surface of the jacket shell at said point approximately one inch rearward of the jacket shell leading edge.

3. A propeller assembly as recited in claim 2 wherein: said hub has a leading edge and lagging edge, said leading edge having a forward extension to fit inboard/outboard and outboard engines.

4. A propeller assembly as recited in claim 3 wherein: said hub has a standard center bore for an engine shaft and a locknut for attachment to said shaft at the lagging edge of said hub.

5. A propeller assembly as recited in claim 4 wherein: said blade root edge is that portion of the blade fixed to the hub; and said tip edge is that portion of the blade joined to the inside surface of the jacket, wherein said tip and blade jacket edges are formed as a single unit.

6. A propeller assembly as recited in claim 5 wherein: the leading edge of each blade is generally straight and extends from the jacket shell inside surface to said hub.

7. A propeller assembly as recited in claim 6 wherein: the junction of each blade leading edge and root edge are fixed to the hub at a point one inch rearward of the junction of each blade leading edge and tip edge.

8. A propeller assembly as recited in claim 7 wherein: the tip and root edges of each blade curve helically rearward from the leading edge of each blade along the jacket and hub until reaching the lagging edge of each blade.

9. A propeller assembly as recited in claim 8 wherein: the lagging edge of each blade is slightly cupped.

10. A propeller assembly as recited in claim 9, wherein: each blade has a trough formed therein from blade leading edge to blade lagging edge.

* * * * *